US005218443A

United States Patent [19]

Ricaud et al.

[11] Patent Number: 5,218,443

[45] Date of Patent: Jun. 8, 1993

[54] TELEVISION CAMERA TUBE WITH SPURIOUS IMAGE BLACK-OUT SCREEN

[75] Inventors: Jean-Luc Ricaud, Voreppe; Gérard Guilhem, Saint Egreve, both of France

[73] Assignee: Thomson-CSF, Puteaux, France

[21] Appl. No.: 339,724

[22] Filed: Apr. 18, 1989

[30] Foreign Application Priority Data

Apr. 22, 1988 [FR] France ..... 88 05348

[51] Int. Cl.[5] ..... H01J 29/70

[52] U.S. Cl. ..... 358/223; 313/424; 313/450

[58] Field of Search ..... 358/223, 220; 313/424, 313/447, 450

[56] References Cited

U.S. PATENT DOCUMENTS 2,719,243 9/1955 Hoagland ..... 313/450
4,075,533 2/1978 Janko ..... 313/424

FOREIGN PATENT DOCUMENTS 0724782 12/1965 Canada ..... 313/447
0168079 1/1986 European Pat. Off. .
2144742 2/1973 France .

OTHER PUBLICATIONS

Patent Abstracts of Japan, vol. 11, No. 367 (E-561)[2814], Nov. 28, 1987; & JP-A-62 139 234 (Matsushita Electronics Corp) Jun. 22, 1987.

Patent Abstracts of Japan, vol. 9, No. 85 (E-308) [1808] Apr. 13, 1985; & JP-A-59 215 639 (Nippon Hoso Kyokai) Dec. 5, 1984.

N.H.K. Laboratories Note, No. 322, Nov. 1985, pp. 3-16, M. Kurashige et al.: L"1-inch magnetic-focus electrostatic-deflection compact saticon for HDTV".

*Primary Examiner*—Edward L. Coles, Sr.
*Assistant Examiner*—Jill Jackson
*Attorney, Agent, or Firm*—Oblon, Spivak, McClelland, Maier & Neustadt

[57] ABSTRACT

A television camera tube with spurious image black-out screen is disclosed. Especially in image pick-up tubes where the electron beam, scanning a photosensitive target, is oriented by a system of electrostatic deflection, it has been observed that spurious images appear in the output video signal of the tube. These images are apparently due to a return beam that comes back from the target and strikes the accelerating electrode of the electron gun. To black out these spurious images, it is proposed to mask the accelerating electrode with a masking screen carried, in principle, to the same potential as the electrode, this screen being characterized by its rounded edges, with their convexity pointed towards the target. It is perforated with a central aperture, also provided with rounded edges.

30 Claims, 4 Drawing Sheets

FIG_2A
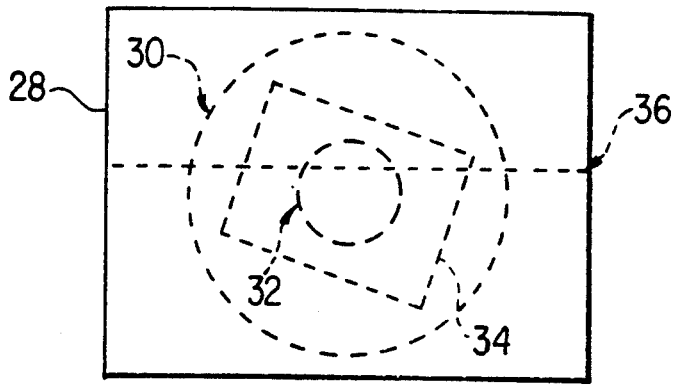
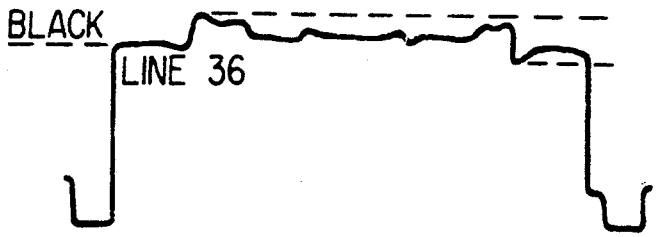
FIG_2B
FIG_4
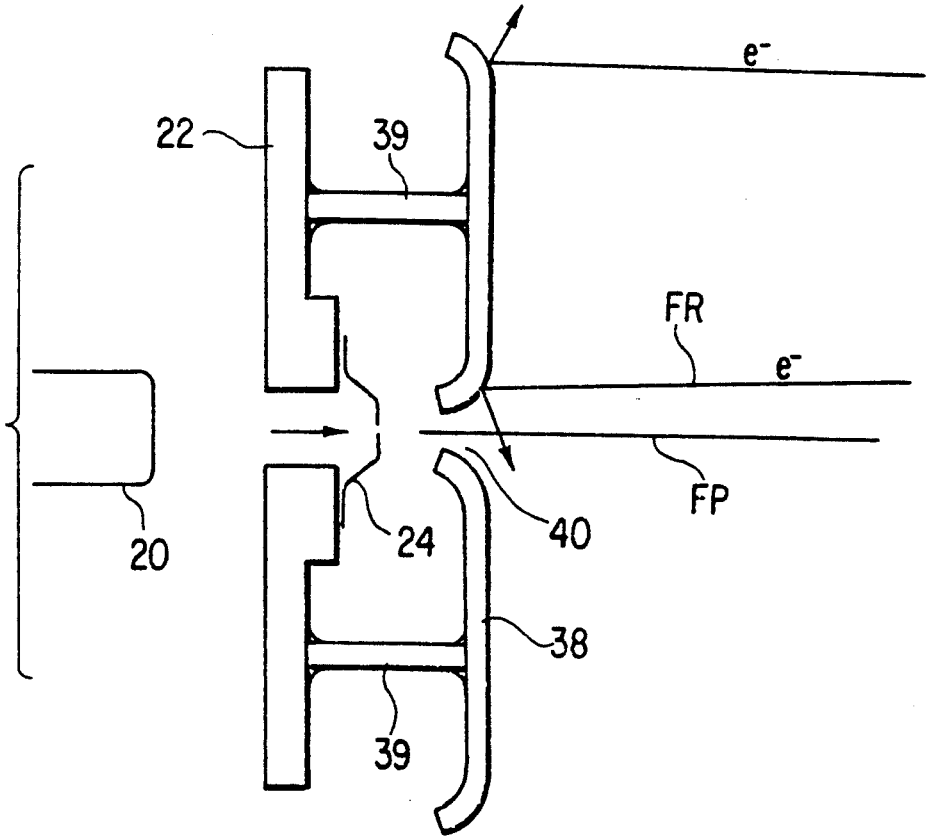

TELEVISION CAMERA TUBE WITH SPURIOUS IMAGE BLACK-OUT SCREEN

BACKGROUND OF THE INVENTION

1. Field of the Invention

The invention concerns television cameras having an electronic image pick-up tube.

2. Description of the Prior Art

The electronic image pick-up tube is a vacuum tube, a front surface of which is formed by a photosensitive target on which is focused, by lenses or other optical means, an image which is sought to be converted into an electrical signal known as a video signal.

The tube has an electron gun placed in the rear of the photosensitive target to produce a narrow electron beam, focusing means to focus this beam on the photosensitive target, and deflection means to make the beam (and consequently its point of impact on the target) scan the surface of the target or a part of this surface.

The scanning is generally a line-by-line scanning, possibly by interlaced half-frames, in accordance with television scanning standards. Most usually, the scanned surface is rectangular and the target is circular, with a diameter which is greater than the diagonals of the rectangle.

The electron beam focusing means may be electromagnetic (coils surrounding the electron gun) or electrostatic.

The electron beam deflection means may also be electromagnetic or electrostatic.

The electron gun generally consists of an emissive cathode from which there emerge electrons, or an accelerating electrode placed in front of the cathode and taken to a potential of a few hundreds of volts. There may possibly be different grids between the cathode and the accelerating electrode, in particular a control grid (Wehnelt) by which the intensity of the emitted beam can be adjusted.

The accelerating electrode is provided with a diaphragm perforated with a very narrow hole (a few hundreds of micrometers for example) limiting the diameter of the electron beam emitted in the tube.

Finally, the tube has a grid called a "field grid" placed in the vicinity of the target, taken to a high potential, for example, 1000 volts, enabling the creation, in the vicinity of the target, of a strong electrical field perpendicular at all points to the surface of the target, the latter being carried to a potential of a few hundred volts at the maximum. This field grid enables the electrons of the beam to strike the target as perpendicularly as possible even when the overall deflection angle of the electron beam between the output diaphragm and the target is great.

To supply a video signal representing the illumination of each point of the target, it is provided that the front face of the target should be coated with a transparent electrode connected to an output connection terminal at which the video signal will be read.

The tube works as follows: the image is focused, from the exterior, on the front face of the target, through the glass envelope of the tube and through the transparent front electrode, and is represented, at each point of the target, by a localized illumination which locally creates electrical charges (electron/hole pairs) proportionate to the illumination at this point. The electrical field in the material of the photosensitive target attracts positive charges towards the real face of the target, namely towards the inside of the tube, namely again, on the side where the target is struck by the beam of electrons. To produce this electrical field, it is seen to it that the mean potential of the front electrode is positive with respect to the tube cathode potential.

The electron beam scans each point of a rectangular zone of the target. At each point, it conveys electrons which compensate for the positive electrical charges that get accumulated at this point on the rear face of the target. A charge of current then flows from the output electrode towards the target to compensate for the localized charge modification thus produced. This charge current varies from one point to another, as a function of the illumination of the points. The result is an electrical signal that varies at the output terminal, said this signal representing the illumination of the target, line by line in a frame and a point by point in each line.

An irksome problem has been noted in certain camera tubes: the video signal collected at the output of the tube represents the superimposition of the real image, focused on the target, and a spurious image.

This spurious image phenomenon is pronounced in the case of a tube with electromagnetic focusing and electrostatic deflection. This is the case taken herein as an example.

The spurious image has been identified by its form: in practice, there are two spurious images. One of them is a precise representation, reduced by a factor approximately equal to two, of the accelerating electrode of the electron gun. The other spurious image represents, also reduced and rotated by about 30°, the scan rectangle of the electron beam when the scanning is rectangular.

In searching for the cause of these spurious images, the following conclusion has been reached: the electrons of the beam that reach the photosensitive target are not all absorbed by the target, since the absorption depends locally on the illumination. Those that are not absorbed set off again, accelerated by the field grid which is taken to 1000 volts. A proportion of these electrons again crosses this gate, which has a transparency to electrons of about 50%. These electrons strike the accelerating electrode that occupies the major part of the section of the tube in front of the electron gun. By reflection and by secondary emission of electrons, the accelerating electrode then behaves like an ancillary source of electron, that is, the electron gun no longer emits only one very narrow beam through the very small aperture of the diaphragm of the accelerating electrode. It also emits an ancillary beam from every point of the surface of the accelerating electrode. This beam goes back towards the target and gets focused and deflected by the focusing and deflection electrodes of the main beam.

This beam lands on the target and produces the same effect as the main beam, almost simultaneously since the period of time taken by the electrons to travel is negligible compared with the television scanning speed. Thus, a spurious video signal is produced and gets added to the main signal. The modulation of this spurious signal corresponds to the image of the accelerating electrode. Furthermore, the interaction between this ancillary beam and the target is weaker if the said beam lands within the scan rectangle than if it lands on the rest of the target, for this latter zone has a higher potential. This effect is responsible for the spurious image of the scan rectangle.

The spurious images are especially visible and irksome in electromagnetic focusing and electrostatic deflection tubes where there is excellent focusing of one plane on another, so that there is a perfect view of the image of the accelerating electrode (located, on the whole, in the plane transversal to the axis of the tube and going through the hole of the diaphragm) and the image of the scan rectangle. To put things clearly, these images correspond to a modulation of the video signal, the amplitude of which attains only a few nanoamperes, but they are distinctly visible on a television screen, for the geometrical contours have sharp contrasts.

Several means of preventing these spurious images have been proposed in the prior art. One of them is to coat the accelerating electrode with a layer preventing the re-emission of electrons when this electrode is struck by electrons. The proposed method, based on porous gold, is not wholly satisfactory and is difficult to implement, especially in tubes with high performance characteristics, which necessitate a de-gassing of the tubes at high temperature (about 800° C.): at this temperature, the porous gold would get diffused in the metal forming the electrode and, at any rate, would not retain its porous structure.

It has also been proposed that an elongated tube, conveyed to the potential of the accelerating electrode, could be placed in the axis of the output electron beam of the electron gun. This tube axially surrounds the beam in front of the output diaphragm, on a length which is sufficient, in the axis of the image pick-up tube, to substantially deform the equipotential surfaces in the vicinity of the accelerating electrode. In this way, the electrons that strike the accelerating electrode are reflected in a direction that does not let them be again focused on the target so as to produce a spurious image.

This elongated tube is not entirely satisfactory and, moreover, it calls for an overall increase in the length of the image pick-up tube, whereas one of the advantages of tubes with electrostatic deflection (for which the spurious image is the most pronounced) is precisely the reduction in the overall length of the image pick-up tube.

Finally, it has been proposed that another electrode, called a repulsion electrode, should be placed in front of the accelerating electrode. Electrons of the return beam, coming from the target, come to this repulsion electrode. This electrode is electrically insulated from the accelerating electrode and is carried to a different potential. This potential causes the incident electrons to be reflected with a level of energy and in a direction such that they are no longer focused on the target when they set off again.

The drawback of this latter structure is evidently the need to provide for a mounting of an additional electrode, insulated from the accelerating electrode, and for a separate electrical supply for this electrode.

To avoid the drawbacks of prior art image pick-up tubes, the present invention proposes the placing, in front of the accelerating electrode, of a screen to mask this electrode, this masking screen having a smooth surface, without discontinuities, and having rounded edges, so that, from the target, neither any sharp-edged surface nor steps nor, again, any other discontinuities are seen.

As a matter of fact, the starting point of the invention is the observation that when a spurious image of the accelerating electrode gets superimposed, in the output video signal, on the real image projected on the target, this spurious image is particularly visible and irksome because is has transitions. Besides, this is generally the case, for accelerating electrodes have steps and discontinuities on the side pointed towards the target, and these steps get reproduced very clearly in the video signal.

SUMMARY OF THE INVENTION

More precisely, the invention proposes, therefore, an electronic image pick-up tube comprising an electron gun and a photosensitive target, the gun comprising notably a cathode emitting an electron beam and, in front of the cathode, an accelerating electrode provided with a diaphragm perforated with a hole that limits the diameter of the electron beam. The tube comprises, in front of the diaphragm, a masking screen for the accelerating electrode, the screen having an aperture facing the hole of the diaphragm, and the screen further having a surface devoid of discontinuities or abrupt steps, on the macroscopic scale, on the target side and having rounded edges with their convexity pointed towards the target, both on the periphery and around its aperture facing the diaphragm.

Through this structure, a very great reduction of the spurious image of the accelerating electrode is obtained, since the modulation on the video signal has a form that no longer shows any abrupt steps and, hence, results in an image with less contrast on a television screen.

The masking screen is preferably taken to the same potential as the accelerating electrode but, in certain cases, it may also be taken to a different potential that modifies the energy of re-emission of the secondary electrons that strike it, so that these electrons are not focused again on the target. The potential is, for example, a potential that is appreciably more positive than that of the accelerating electrode.

Preferably, the front surface of the masking screen is given a structure with a low secondary emission of electrons, to reduce the throughput rate of the ancillary beam and hence reduce the amplitude of the modulation corresponding to the spurious images of the accelerating electrode and of the scan rectangle.

In particular, preferably the choice will be made of giving the front surface (pointed towards the target) a rough texture on the microscopic scale. This rough texture may be obtained, for example, by chemical attacking process with hot hydrochloric acid when the front surface is made of stainless steel.

Preferably again, the rough-textured surface is coated with a microporous layer, preferably of carbon, or possibly of "black" tungsten or titanium, i.e. tungsten or titanium with high porosity.

BRIEF DESCRIPTION OF THE DRAWINGS

Other features and advantages of the invention will appear from the following detailed description, made with reference to the appended drawings, of which:

FIG. 2A shows the spurious image reproduced in the output video signal of the tube, FIG. 2B shows the corresponding deformation of the black level on a scan line.

FIG. 4 shows, on a bigger scale, the mounting of the screen with rounded edges on the accelerating electrode;

DESCRIPTION OF PREFERRED EMBODIMENTS

Figure 1:
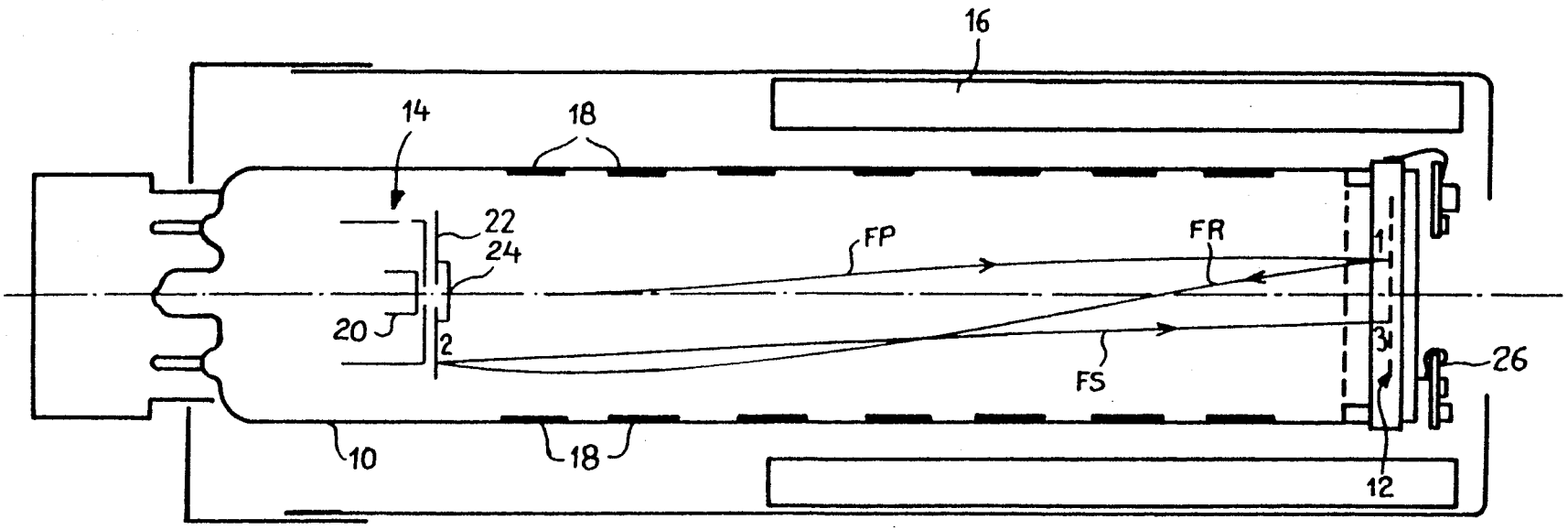
FIG 1 PRIOR ART
FIG. 1 shows a general view of a standard image pick-up tube.

The standard image pick-up tube of FIG. 1 has a vacuum tube 10, the front face of which is a photosensitive target 12. An electron gun 14 is placed behind the tube. Electromagnetic deflection coils 16 surround the tube. Electrostatic deflection electrodes 18 are formed at the periphery of the tube.

The electron gun has an emissive cathode 20 and, in front of the cathode, an accelerating electrode 22 provided with a diaphragm 24 perforated with a small hole to let through a narrow beam of electrons.

The video signal arising from the scanning of the target by the beam is collected at an output terminal 26, connected to a transparent electrode on the front surface of the target.

The typical path of the electrons has been shown in FIG. 1. The primary beam, FP, coming from the electron gun through the diaphragm 24, strikes the target at a point 1. A certain proportion of the beam is absorbed because, at the point of impact, the stored charge has an intermediate value between the white level (maximum illumination) and the black level (null illumination). The unabsorbed electrons are sent back, towards the rear, in the form of a return beam FR. Of this beam FR, one part is absorbed by the field grid in the vicinity of the target and another part returns to the accelerating electrode 22. The return beam FR returns all the more as the electrostatic deflection electrodes come into play both for the primary beam and for the return beam. The electron intensity of the return beam may attain, for example, 20% of that of the primary beam.

The point of impact of the return beam FR on the accelerating electrode 22 is designated by the reference 2. This point of impact moves, evidently, with the scanning of the main beam and the return beam. The point 2 therefore moves all over the surface of the accelerating electrode 22, including the diaphragm 24 if this diaphragm 24 is placed in front of the electrode.

The accelerating electrode 22 emits secondary electrons with a coefficient of secondary emission that depends on the nature of its surface. Usually, the coefficient of secondary emission is 1.5 (for example, for an accelerating electrode made of stainless steel), i.e. for n incident electrons on the surface, $1.5 \times n$ electrons set off again. The quantity of electrons that set off again remains constant so long as the point of impact 2 scans a surface which is uniform and has a homogeneous nature, but it changes suddenly if it encounters an unevenness such as the edge of a part or a sharp corner. In other words, the quantity of electrons that sets off again is modulated according to the local state of the surface of the accelerating electrode, hence it carries, within it, the information on the image of this surface.

Besides, it is known that, of these secondary electrons, one part has the same energy as the incident electrons (this part is called the elastic peak of the secondary emission spectrum), i.e. the energy corresponding to the potential of the accelerating electrode. Thus, these electrons set off again from the accelerating electrode with the same speed as the main beam leaving through the hole of the diaphragm, and are therefore focused and deflected with the same efficiency. These electrons form a secondary beam FS, the original beam of which scans the surface of the accelerating electrode. This beam is again focused by the focusing means 16, and it undergoes the scanning deflection created by the deflection means 18.

A certain proportion of the electrons of the secondary beam FS actually strikes the target. The point of impact is designated by the reference 3. They generate a current in the output terminal 26. The intensity of the current depends on the quantity of charges present at the point of impact 3.

The current going in the terminal 26 at a given instant is thus the sum of the normal current, corresponding to the charge at the point 1 (corresponding to the real illumination of an image spot) and a spurious current. The interaction of the secondary beam FS differs according to whether the point of impact 3 is located in the scan rectangle or in the rest of the target. For, in the first zone, the surface potential is periodically brought to about zero volts (zero volts is conventionally the potential of the cathode) by the primary beam FP. On the contrary, the second zone has a potential which is higher and which is, therefore, more favorable to the absorption of the secondary beam FS.

Consequently, when the point of impact 3 is in the first zone, the spurious current is greatly reduced, so that the extent of the spurious image of the scan rectangle appears to be uniformly black. By contrast, when the point of impact 3 is in the second zone, the point of impact 3 is, according to a first approximation, proportionate to the intensity of the secondary beam FS which is itself modulated according to the image of the accelerating electrode. On the assumption that there is no image (null illumination of the entire target), a constant video signal corresponding to black should be collected. In fact, a non-constant video signal is obtained, for it includes the spurious current. If the image corresponding to this video signal is reproduced, two things are found: firstly, an image of the accelerating electrode and, secondly, an image of the scan rectangle of the target. Beside, each of these images is rotated by a certain angle owing to the fact that the focusing and deflection means make the electron beam undergo a rotation.

FIG. 2A gives a schematic view of the spurious image produced in the video signal by the secondary beam. Circles are seen inside the scan rectangle 28 of the normal image. These circles are images, reduced by a factor of 2, of the periphery of the accelerating electrode (circle 30) and of the periphery of other abrupt contours of the accelerating electrode (the contour of the diaphragm 24, for example, or any other abrupt step in the surface of the electrode 22). One of these contours gives rise, for example, to an image in the form of the circle 32. There is also the image of a rectangle 34 which is the image, with reduced dimensions and rotated by about 30°, of the video image scan rectangle.

FIG. 2B shows the shape of a line of the video signal (for example, corresponding to an image line designated by the reference 36), assuming that the target is not illuminated. This video signal has big and sharp variations whereas it should have been constant between two synchronization pulses.

Figure 3:
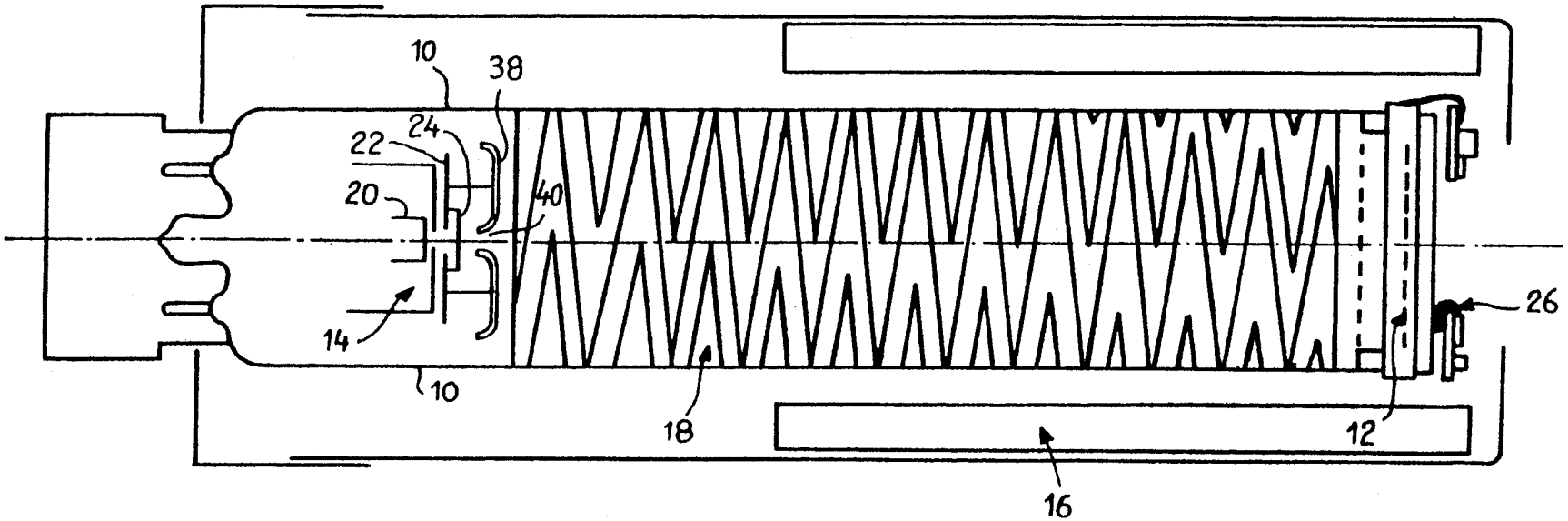
FIG. 3 shows a view of the tube according to the invention, with a masking screen having rounded edges.

FIG. 3 shows the modification of the structure provided by the present invention. A masking screen 38 is placed in front of the accelerating electrode 22. This screen receives almost all of the return beam FR. It masks the accelerating electrode, i.e. it prevents the return beam FR from striking its front face or, at any rate, those of its parts that have abrupt steps. However, this screen has a central aperture 40 to let through the primary beam at the output of the diaphragm. Its edges are rounded, both at its periphery and around its central aperture 40. The convexity of the rounded edges is pointed towards the target. The front surface of the screen, namely the surface of the screen pointed towards the target, thus has no discontinuity or sudden steps on the macroscopic scale.

The screen is solidly joined to the accelerating electrode 22 and is preferably taken to the same potential as it, but a possibility can be envisaged where it is taken to a different potential, a positive potential, to restrict the re-emission of secondary electrons towards the target.

FIG. 4 gives a detailed view of the mounting of the masking screen 38 in front of the accelerating electrode 22 and the diaphragm 24. The front is the right-hand side of the figure as in FIGS. 1 and 3. For an accelerating electrode diameter of about 10 to 20 millimeters, the radius of curvature of the rounded edges may be about one to three millimeters. The screen may be welded in front of the electrode 22 and the diaphragm 24, using ties 39.

The screen is preferably made of stainless steel.

On the microscopic scale (which is invisible to the naked eye), the front surface of the screen is rough (it may therefore have sudden steps and uneven features), again in order to reduce the re-emission of secondary electrons. The roughness is obtained, for example, by attacking the stainless steel in an acid bath.

Preferably, the rough surface is coated with a very thin layer (which is non-smoothing, i.e. which is not likely to make the roughness disappear) of a material with low secondary emission. This material is preferably carbon, but it may also be black titanium or tungsten (metals deposited under conditions where they acquire high porosity)

Figure 5:
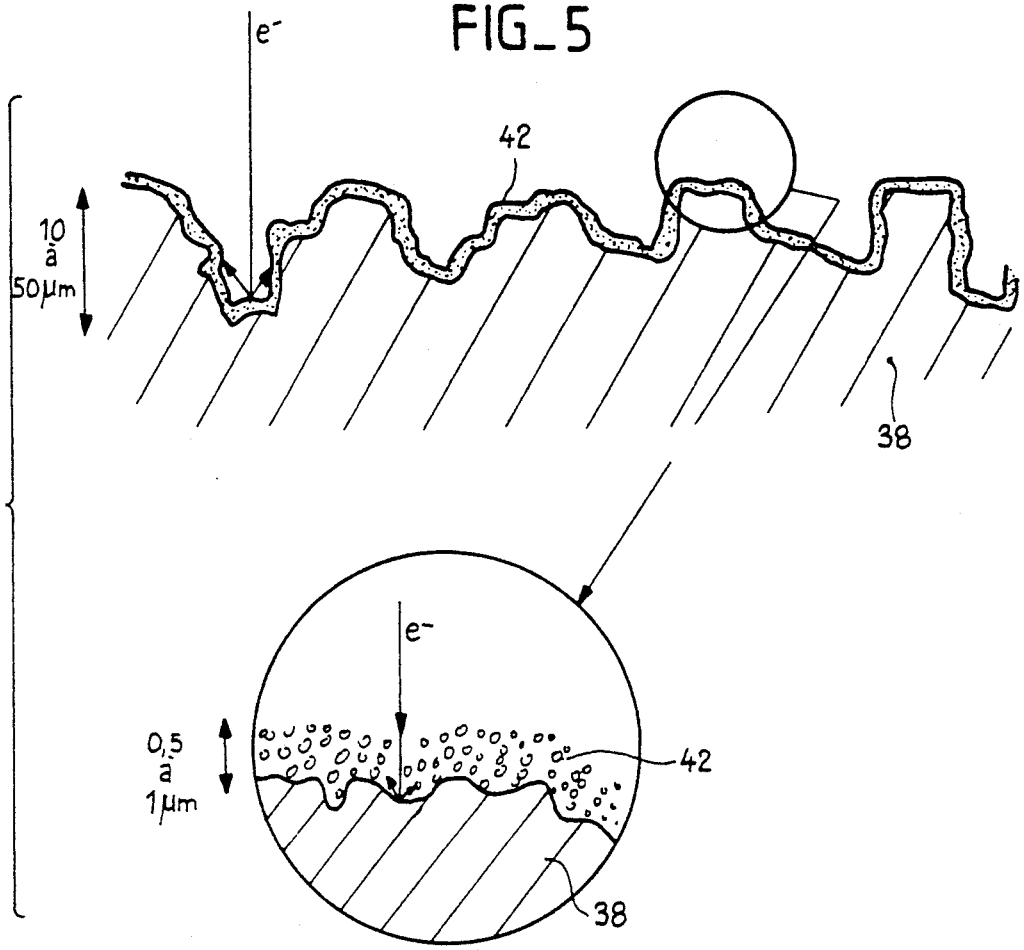
FIG. 5 shows the rough microscopic texture of the screen.

FIG. 5 gives a schematic view of the front surface of the screen 38 at the microscopic level. The surface has rough features with depths ranging from several micrometers to several tens of micrometers. This surface is coated with a microporous layer 42, with a thickness of several thousands of angstroms, made of carbon for example.

FIG. 5 also shows an enlarged detail of the surface, showing the rough surface coated with a porous layer 42 of carbon and showing how an incident electron is absorbed by this porous layer, in the sense that the secondary electrons generated by it are trapped in the pores.

Figure 6:
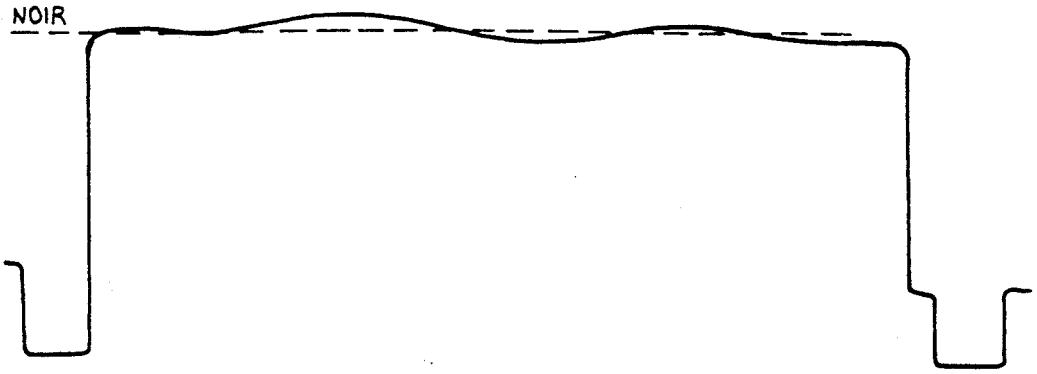
FIG. 6 shows the improved black level obtained by means of the improvement according to the invention.

FIG. 6 shows the video signal corresponding to a scanning line with the structure according to the invention, when there is no illumination of the target. The variations in the black level have been reduced by a factor of 10 in amplitude and, furthermore, they are smooth and, therefore, do not produce a spurious image with contrasts, which is far more obvious and irksome than an image with little contrast.

We claim:

1. An electronic image pick-up tube comprising:

an electron gun and a photosensitive target, said electron gun comprising a cathode for emitting an electron beam and, in front of the cathode, an accelerating electrode having a face turned towards the target and a face turned towards the cathode, said accelerating electrode provided with a diaphragm perforated with a hole that limits the diameter of the electron beam, said gun further comprising a masking screen for the accelerating electrode, said screen having a side turned towards the accelerating electrode and a side turned towards that target and further having an aperture in front of said hole of the diaphragm, said screen being located close to the accelerating electrode on that side of the accelerating electrode that is turned towards the target, said screen further having a surface devoid of discontinuities or abrupt steps, on the macroscopic scale, on its die turned towards the target, and having rounded edges both on the periphery of the masking screen and around its aperture in front of said hole of the diaphragm, the convexity of said rounded edges being turned towards the target, so that, seen from the target no surface with abrupt edges, concavities or discontinuities is apparent, wherein the screen is at the same potential as the accelerating electrode.

2. A tube according to claim 1, wherein the front surface of the masking screen has a structure with low secondary emission of electrons.

3. A tube according to claim 2, wherein the front surface of the screen has a rough texture on the microscopic scale.

4. A tube according to claim 3, wherein front surface is made of stainless steel.

5. A tube according to claim 3, wherein the depth of the rough features ranges from about ten to several tens of microns.

6. A tube according to claim 2, wherein the front surface of the screen is coated with a microporous layer of a material with a low coefficient of secondary emission.

7. A tube according to claim 6, wherein the microporous layer is a layer of carbon, or possibly of "black" tungsten o titanium, that is, of titanium or tungsten with high porosity.

8. A tube according to claim 7, wherein the microporous layer has a thickness of several thousands of angstroms.

9. An electronic image pick-up tube comprising:

an electron gun comprising a cathode for emitting an electron beam;

an accelerating electrode for accelerating said electron beam and comprising a diaphragm perforated with a first aperture through which said accelerated electron beam passes, said diaphragm limiting a diameter of said accelerated electron beam;

a masking screen located next to said accelerating electrode in a direction of propagation of said accelerated electron beam, said masking screen having a first face facing said accelerating electrode and a second face facing a photosensitive target on which said accelerated electron beam impinges, said masking screen having a second aperture aligned with the first aperture of said diaphragm, wherein the second face of said masking screen is devoid of discontinuities and abrupt steps at a macroscopic level, and said masking screen has rounded edges on its periphery and around the second aperture such that the second face of said masking screen is convex as viewed from said photosensitive target;

wherein the masking screen is at the same potential as the accelerating electrode.

10. The electrode image pick-up tube according to claim 9, wherein the first face of the masking screen has a structure with a low secondary emission of electrons.

11. The electronic image pick-up tube according to claim 10, wherein the first face of the masking screen has a rough texture at a microscopic level.

12. The electronic image pick-up tube according to claim 11, wherein the first face is made of stainless steel.

13. The electronic image pick-up tube according to claim 12, wherein a depth of the rough texture ranges from about ten to several tens of microns.

14. The electronic image pick-up according to claim 10, wherein the first face of the masking screen is coated with a microporous layer of a material with a low coefficient of secondary emission.

15. The electronic image pick-up tube according to claim 14, wherein the microporous layer is a layer of carbon, or titanium or tungsten with high porosity.

16. The electronic image pick-up tube according to claim 15 wherein the microporous layer has a thickness of several thousands of angstroms.

17. An electronic image pick-up tube comprising:

an electron gun and a photosensitive target, said electron gun comprising a cathode for emitting an electron beam and, in front of the cathode, an accelerating electrode having a face turned toward the target and a face turned towards the cathode, said accelerating electrode provided with a diaphragm perforated with a hole that limits the diameter of the electron beam, said gun further comprising a masking screen for the accelerating electrode, said screen having a side turned towards the accelerating electrode and a side turned towards the target and further having an aperture in front of said hole of the diaphragm, said screen being located close tot he accelerating electrode on that side of the accelerating electrode that is turned towards the target, said screen further having a surface devoid of discontinuities or abrupt steps, on the macroscopic scale, on its side turned towards the target, and having rounded edges both on the periphery of the masking screen and around its aperture in front of said hole of the diaphragm, the convexity of said rounded edges being turned towards the target, so that, seen from the target no surface with abrupt edges, concavities or discontinuities is apparent, wherein the front surface of the masking screen has a structure with a low secondary emission of electrons.

18. A tube according to claim 17, wherein the front surface of the screen has a rough texture on the microscopic scale.

19. A tube according to claim 18, wherein the front surface is made of stainless steel.

20. A tube according to claim 18, wherein the depth of the rough features ranges from about ten to several tens of microns.

21. A tube according to claim 17, wherein the front surface of the screen is coated with a microporous layer of a material with a low coefficient of secondary emission.

22. A tube according to claim 21, wherein the microporous layer is a layer of carbon, or possibly of "black" tungsten or titanium, that is, of titanium or tungsten with high porosity.

23. A tube according to claim 22, wherein the microporous layer has a thickness of several thousands of angstroms.

24. An electronic image pick-up tube comprising: an electron gun comprising a cathode for emitting an electron beam;

an accelerating electrode for accelerating said electron beam and comprising a diaphragm perforated with a first aperture through which said accelerated electron beam passes, said diaphragm limiting a diameter of said accelerated electron beam;

a masking screen located next to said accelerating electrode in a direction of propagation of said accelerated electron beam, said masking screen having a first face facing said accelerating electrode and a second face facing a photosensitive target on which said accelerated electron beam impinges, said masking screen having a second aperture aligned with the first aperture of said diaphragm, wherein the second face of said masking screen is devoid of discontinuities and abrupt steps at a macroscopic level, and said masking screen has rounded edges on its periphery and around the second aperture such that the second face of said masking screen is convex as viewed from said photosensitive target;

wherein the first face of the masking screen has a structure with a low secondary emission of electrons.

25. The electronic image pick-up tube according to claim 24, wherein the first face of the masking screen has rough texture at a microscopic level.

26. The electronic image pick-up tube according to claim 25, wherein the first face is made of stainless steel.

27. The electronic image pick-up tube according to claim 25, wherein a depth of the rough texture ranges from about ten to several tens of microns.

28. The electronic image pick-up according to claim 24, wherein the first face of the masking screen is coated with a microporous layer of a material with a low coefficient of secondary emission.

29. The electronic image pick-up tube according to claim 28, wherein the microporous layer is a layer of carbon, or titanium or tungsten with high porosity.

30. The electronic image pick-up tube according to claim 29, wherein the microporous layer has a thickness of several thousands of angstroms.

* * * * *